United States Patent [19]

Yamada

[11] 4,064,578

[45] Dec. 27, 1977

[54] THERAPEUTIC CUSHION

[76] Inventor: Junji Yamada, 1-11, 2-chome, Higashinihonbashi, Chuo, Tokyo, Japan

[21] Appl. No.: 634,510

[22] Filed: Nov. 24, 1975

[30] Foreign Application Priority Data

June 15, 1975 Japan ..... 50-75116

[51] Int. Cl.[2] ..... A47C 7/20

[52] U.S. Cl. ..... 5/355; 5/361 B; 297/452

[58] Field of Search ..... 5/355, 361, 361 B, 92; 297/452, 454, 456

[56] References Cited

U.S. PATENT DOCUMENTS

| | | | |
|---|---|---|---|
| 2,612,158 | 9/1952 | Manley | 5/361 R |
| 3,242,511 | 3/1966 | Fultz et al. | 5/338 X |
| 3,258,791 | 7/1966 | Kaplan | 5/361 B X |
| 3,266,066 | 8/1966 | Bereday | 297/456 |
| 3,301,574 | 1/1967 | Good | 297/DIG. 4 |
| 3,443,267 | 5/1969 | Schuckman | 5/361 R X |
| 3,866,252 | 2/1975 | Rogers | 5/361 B X |

*Primary Examiner*—Casmir A. Nunberg

*Attorney, Agent, or Firm*—Birch, Stewart, Kolasch and Birch

[57] ABSTRACT

A therapeutic seat cushion for use with a chair which comprises a sponge mat layer provided with an underlying slider layer, said sponge mat layer comprising a polymeric foam containing a plurality of projections which extend from the surface of the sponge mat layer and prevent any malfunction in the blood circulation of the body, and said slider layer comprising a fibrous material which is capable of shifting in a lateral direction when a lateral force is applied to the sponge mat layer.

17 Claims, 15 Drawing Figures

THERAPEUTIC CUSHION

BACKGROUND AND SUMMARY OF THE INVENTION

The present invention relates to an improved therapeutic cushion which can be used in conjunction with a chair. More particularly, the present invention is directed to a therapeutic cushion for a wheeled chair, said cushion comprising a sponge mat portion and a slider portion which cooperate to provide therapeutic value for the individual using the cushion.

Conventionally, a cushion which is used in conjunction with a chair is formed merely from sponge or cotton wadding, and therefore, an individual sitting on a chair provided with such a cushion, or more particularly, a patient sitting on such a cushion which is placed on a wheeled chair, frequently suffers from a scratching or an abrading action as a result of rubbing against a rough surface of the chair, which contributes to poor circulation of the blood. Thus, when a patient who is in a sitting position wishes to move forward, he generally bends the upper portion of his body in the downward direction and moves the lower portion of his body in the forward direction. In this situation, although the bone, for example, the hip bone or the knuckle bone proceed in the forward direction, the flesh associated with the particular bone does not follow the bone since the flesh is pressed against the cushion and therefore the lower portion of the body surrounding the bone becomes cramped and, in addition, the skin associated with said lower portion of the body is abraded and rubbed against the cushion to the point where it is uncomfortable. Furthermore, since the pressure produced in the body as a result of the above movement is concentrated to certain portions of the lower body, the circulation of the blood is at least momentarily interrupted. Such an interruption in the circulation of the blood is, of course, highly undesirable, especially in the case of a convalescing patient.

Accordingly, an object of the present invention is to provide a therapeutic cushion which overcomes the deficiencies of seat cushions pointed out hereinabove.

Another object of the present invention is to provide a therapeutic cushion which can be used in conjunction with a wheeled chair wherein a patient can shift weight and move in any direction while sitting in said chair without causing discomfort to the body and without adversely affecting the blood circulation of the body.

Other objects and further scope of applicability of the present invention will become apparent from the detailed description given hereinafter; it should be understood, however, that the detailed description and specific examples, while indicating preferred embodiments of the invention, are given by way of illustration only, since various changes and modifications within the spirit and scope of the invention will become apparent to those skilled in the art from this detailed description.

Pursuant to the present invention, the above-mentioned disadvantages may be eliminated and a much improved therapeutic cushion for use in conjunction with a chair, particularly a wheeled chair, may be obtained by providing a cushion made of a sponge mat supported by a slider material which is placed under the sponge mat so that the cushion can move freely, depending upon the movement of the patient's body, thereby preventing any interruption in the circulation of the blood.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
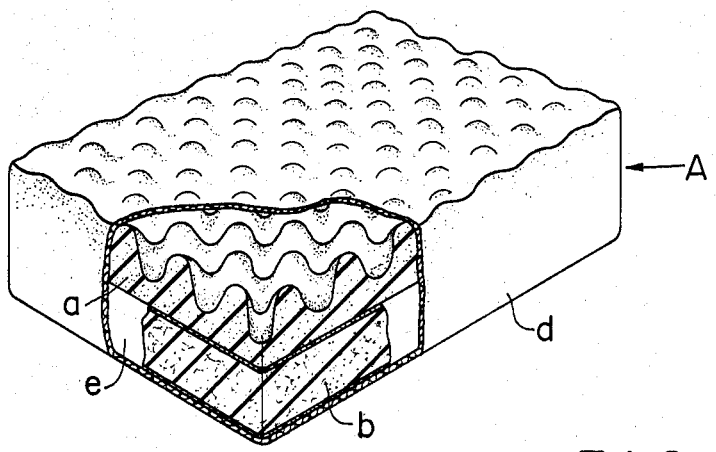
FIG. 1 is a perspective view, partially in section, showing a cushion of the present invention using a particular type of sponge mat.
Figure 2:
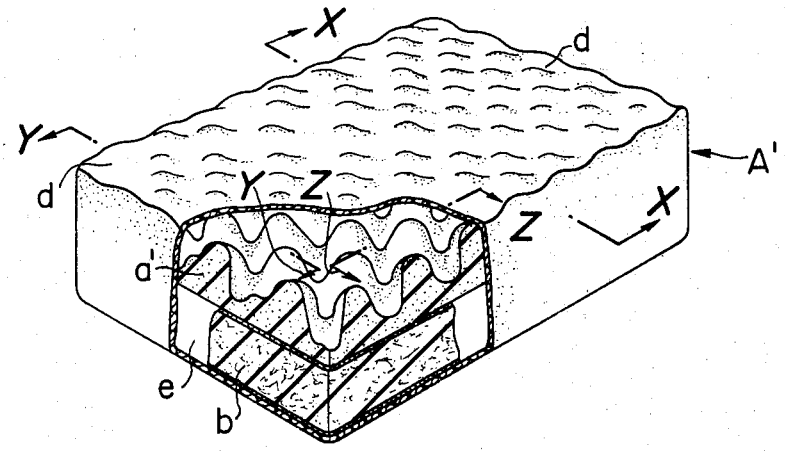
FIG. 2 is a perspective view, partially in section, showing a cushion of the present invention using a different type of sponge mat from that of FIG. 1.
Figure 7:
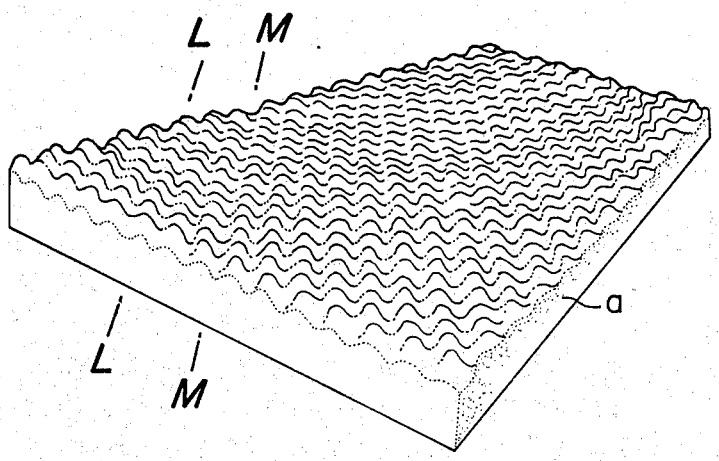
FIG. 7 is a perspective view of the sponge mat used for the cushion shown in FIG. 1.

FIGS. 1 and 2 are perspective views, partially in section, of cushions A and A' having different types of sponge mats *a* and *a'* therein for adversely affecting the circulation of the blood throughout the body. The cushion A in FIG. 1 has a sponge mat *a* in its upper portion and a slider *b* in its lower portion, said sponge mat and slider being enveloped by an air-permeable cover cloth *d*. The sponge mat *a* has a standard specific weight of about 0.03 and a thickness of about 90 mm. One surface of the sponge is provided with a plurality of projections such that the foot or groove *f* in front of, behind, and to the left and right of each projection is greater in depth than the foot or groove *g* disposed at a diagonal to the projection. Thus, for example, the depth of the groove in front of, behind, to the left and to the right of the projection is about 35 mm, whereas the depth of the groove *g* disposed at a diagonal to the projection is about 20 mm. Thus, the pitch of the foot *f* is larger than the pitch of the foot *g*.

The sponge mat utilized in the cushion of the present invention is formed from a plastic material, such as a polyurethane prepared by reacting an isocyanate, for example, tolylene diisocyanate and a polyol, for example, a hydroxyl containing polyester or polyether, and is prepared by mixing them together with water and a catalyst to produce said urethane polymer. The urethane polymer is then foamed by carbonic acid gas generated by the reaction between water and the isocyanate. The following table shows a comparison between the sponge mat using the thus produced sponge and a conventional cushion.

TABLE

| Testing item | | Convensional cushion having uneven surface | Sponge mat according to the invention |
|---|---|---|---|
| Standard specific weight 0.002 (standard difference) | g/cm | 0.018 ± 0.002 | 0.03 ± 0.02 |
| Hardness, compression to 25% of the original size, thickness 100 m/m | kg | 10 ± 2 | 17 ± 2 |
| Compression to 50% of original size (250 thousand times) | | | |
| Decrease in size | % | 3 to 3.5 | 0.75 |
| Decrease in hardness | % | 3 to 40 | 20.6 |
| Hardness fatigue, compression to 50% of original size (250 thousand times) | kg | about 6 | about 11 |
| Permanent strain, compression to 50% of the original size (70° C, 22 hr.) | % | 4 to 6 | 1.51 |

The slider material *b* which is utilized in the seat cushion of the present invention comprises a fibrous material, such as for example, "banya", chaffs, such as rice hulls or husks or buckwheat hulls or husks, feathers, or synthetic resin fibers in a spiral form and treated such that each of the fibers is independent of each other so that said fibers feel somewhat like a feather when touched. The synthetic resin fiber can be made from a polyester resin, for example, Tetron, sold by Toray Inc., of Japan (No. FT) for use as bed quilt wadding. The slider material is enveloped by an envelope *e* in such a manner that the slider material is positioned below the sponge mat *a*.

Figure 11:
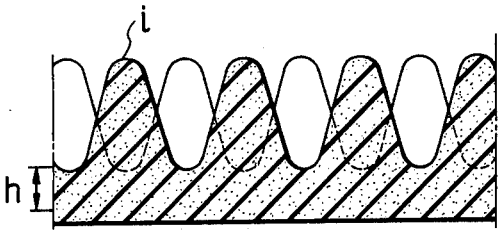
FIGS. 11 and 12 are sections taken along Z—Z and Y—Y, respectively, of the sponge mat used in the cushion of FIG. 2.
Figure 12:
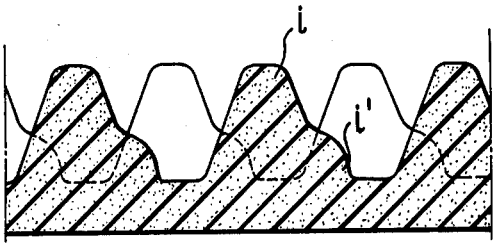

The cushion A' in FIG. 2 is made of materials similar to those mentioned for cushion A of FIG. 1 with the exception that the shape of the sponge mat in FIG. 2 is somewhat different from the shape of the sponge mat of the cushion of FIG. 1. Thus, the sponge mat of the cushion A' in FIG. 2, as further shown in FIGS. 11 and 12, has a large projection *i* and a smaller projection *i'* disposed along the side of the projections *i*. For example, the projections *i* have a height of about 38 mm and are disposed on a base *h* which has a thickness of about 17 mm. The smaller projections *i'*, which are disposed along the side of the projections *i*, have a height of about 15 mm. The distance between each of the projections *i* is about 15 mm, and the smaller projections *i'* are spaced apart from the surrounding three projections *i* a distance of about 40 mm.

Figure 3:
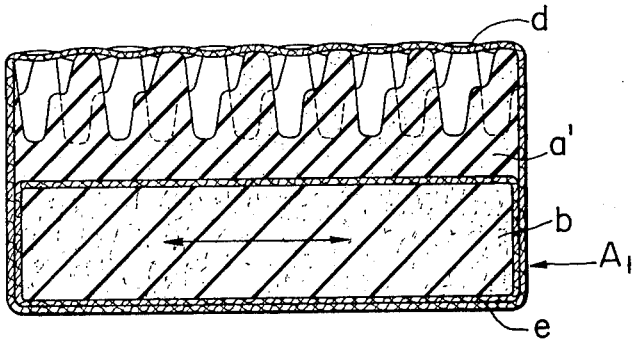
FIG. 3 is a section taken along the line X—X of FIG. 2.
Figure 4:
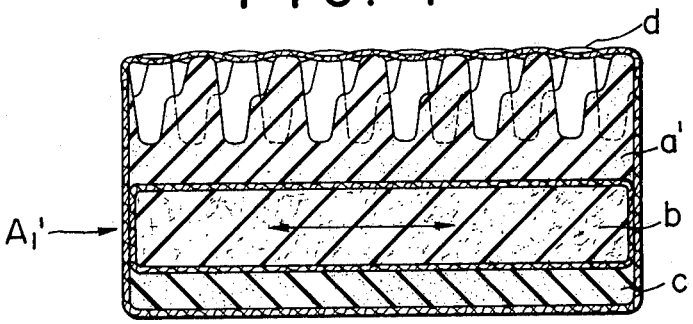
FIGS. 4–6 are sections of various sponge mats which prevent any interruption in the blood circulation of the body.

FIG. 3 shows a section of the cushion A' of FIG. 2. FIG. 4 primarily shows a section of a cushion $A_1'$ which is similar to that of FIG. 3 with the exception that a shock absorbing material or reinforcing body *c* is disposed beneath the slider section *b* so that the patient who sits on the cushion $A_1'$ may feel more comfortable. The shock absorbing material or reinforcing body *c* is formed from a plate-type sponge mat which is harder than the sponge mat *a'*. The shock absorbing material or reinforcing body *c* can be reinforced by a plywood layer and is effective in preventing undesirable blood circulation problems.

Figure 5:
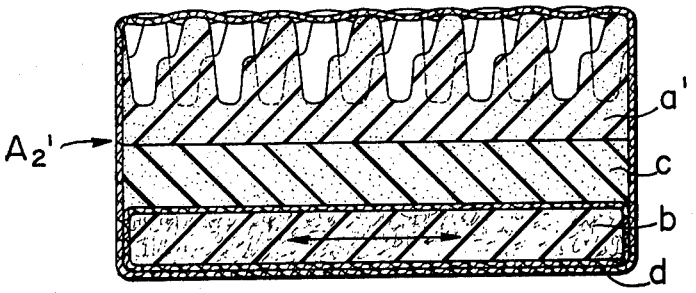
Figure 6:
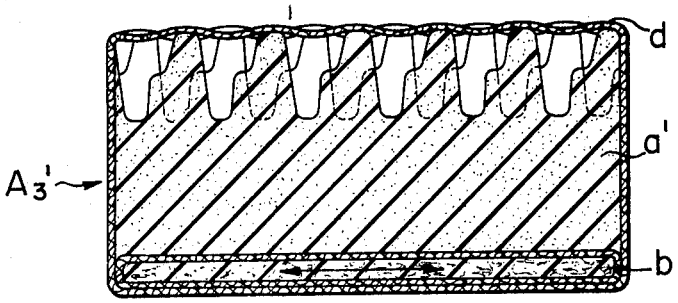
Figure 8:
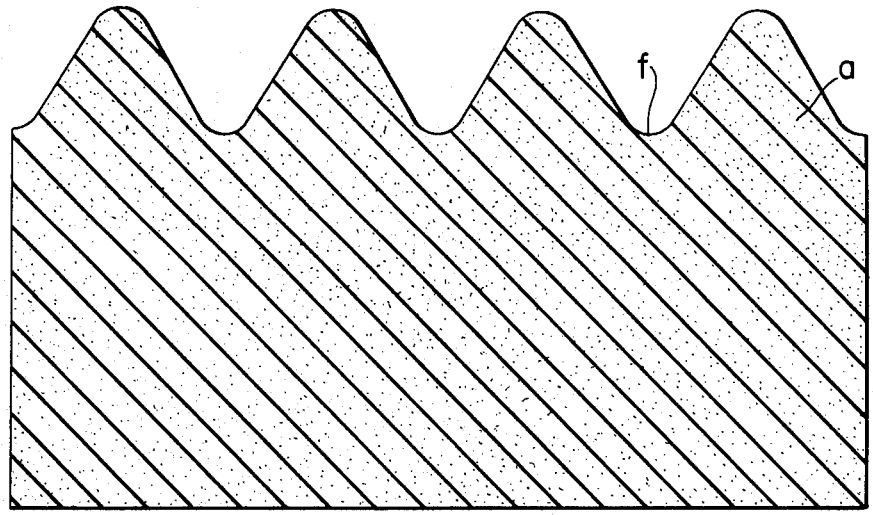
FIGS. 8 and 9 are sections taken along L—L and M—M of FIG. 7.
Figure 9:
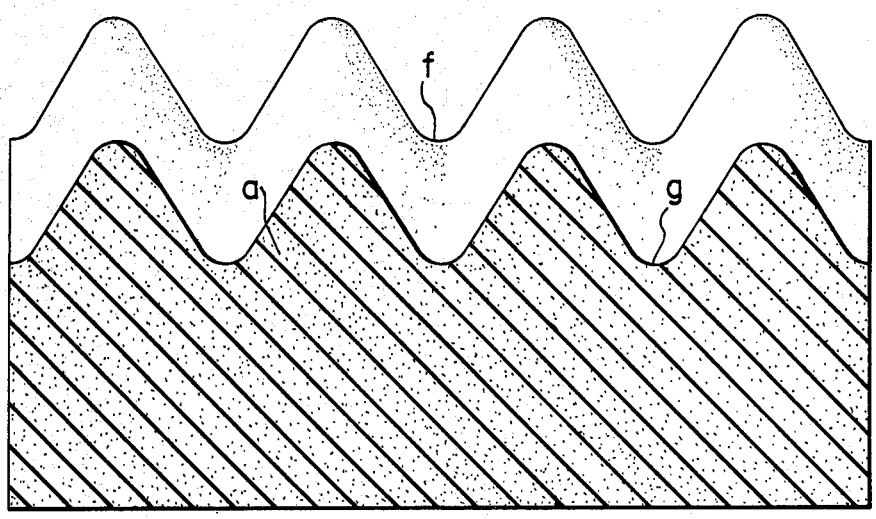
Figure 10:
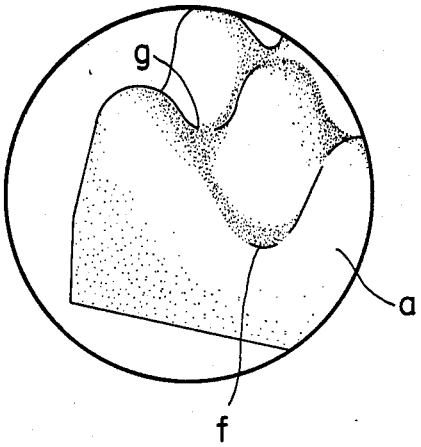
FIG. 10 is an enlarged view of a portion of the sponge mat of FIG. 1.

The cushion $A_2'$, a section of which is shown in FIG. 5, has a reinforcing body *c* disposed above the slider material *b* and the cushion $A_3'$ shown in FIG. 6 has a very thick sponge mat *a'* and a thin slider layer *b*.

Figure 14:
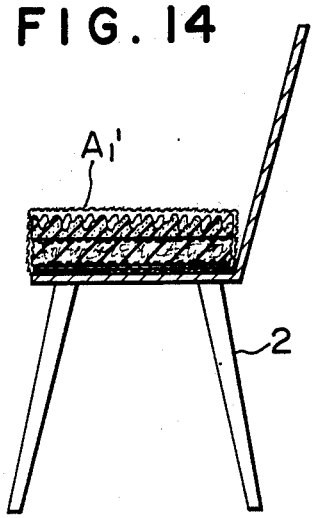
FIGS. 13 and 14 show chairs provided with the cushion of the present invention.
Figure 13:
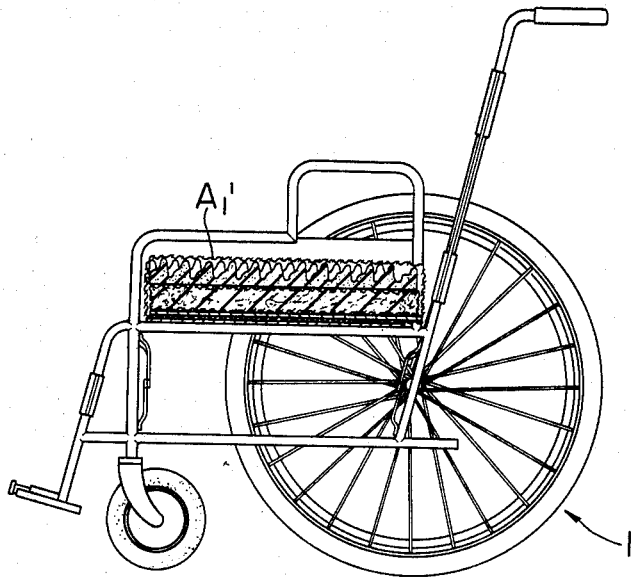
Figure 15:
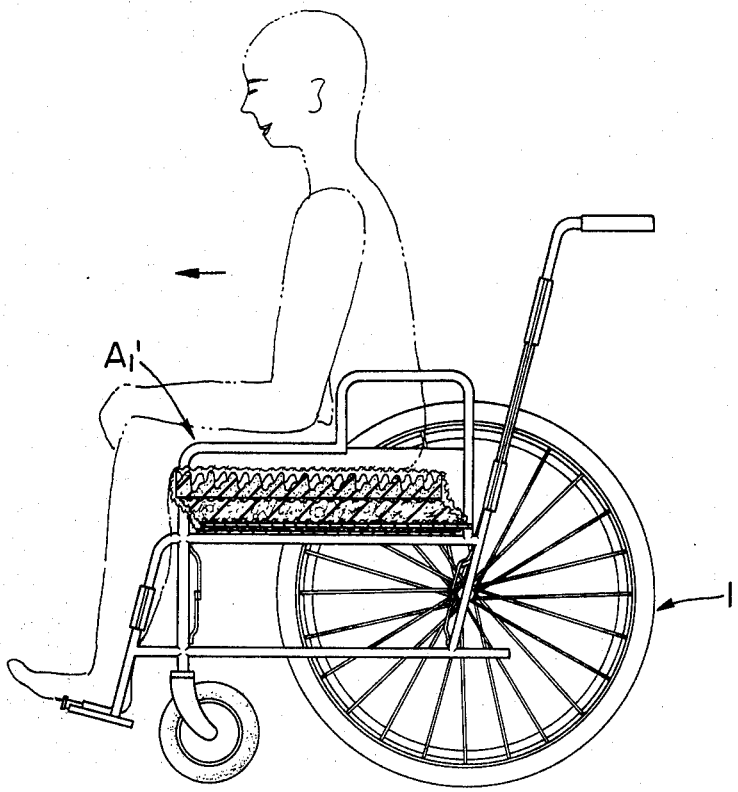
FIG. 15 shows a patient sitting on a cushion as defined by the present invention.

The cushions shown in FIGS. 3–6 show a sponge mat *a'* in which the projections of adjacent rows are staggered relative to one another. The cushions $A_1'$ to $A_3'$ can advantageously be placed on wheeled chairs as shown in FIGS. 13 and 14. When a patient sitting on a cushion $A_1'$ bends his upper body and moves his hip forward, in order to move the wheel chair 1 as shown in FIG. 15, the hip of the patient moves forward together with the cushion $A_1'$. Since the cushion of the present invention contains a slider layer *b* disposed below the sponge mat *a'*, the sponge mat slides freely in the forward direction due to the shifting nature of the slider layer. Accordingly, a patient sitting in a chair, for example a wheeled chair, can move the hips in a back and forth and right and left direction freely by the sliding motion of the slider layer upon which the hips are disposed. Accordingly, no rubbing of the skin, which is very uncomfortable to the patient, occurs.

Furthermore, since the sponge mat which is provided for preventing the interruption of the blood circulation to the body, is structured to have projections so that the pressure applicable portions (projections) and the unapplicable portions located along side of said projections, cooperate such that the pressure, for example, to the hip, can be dispersed so that a pressured portion can be readily moved to a non-pressured portion by a slight movement of the hip. In addition, when a patient desires to move in the forward direction by bending the upper portion of the body and moving the lower hip portion of the body forward, the slider layer slides smoothly in the forward direction, thereby enabling the lower portion of the body to move smoothly in the forward direction without any pressure being applied to the body. Therefore, the patient does not become uncomfortable due to the skin being rubbed and the muscles being cramped.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A therapeutic seat cushion for use with a chair which comprises:

a sponge mat layer comprising a polymeric foam including first and second surfaces;

said first surface contains a plurality of projections which extend from the first surface of the sponge mat layer;

said second surface being substantially flat; and a slider layer comprising a fibrous material positioned adjacent to the substantially flat second surface and being readily shiftable relative to said sponge mat layer;

whereby when a force is applied to said seat cushion by a person positioned on said seat cushion, the relative positioning of the person and the sponge mat layer remains substantially constant relative to each other but shiftable relative to the slider layer thereby facilitating ready and comfortable movement of said person disposed on said seat cushion.

2. The therapeutic seat cushion of claim 1, wherein the sponge mat layer and slider layer are encased by an air-permeable cover material.

3. The therapeutic seat cushion of claim 1, wherein the sponge mat layer is polyurethane foam.

4. The therapeutic seat cushion of claim 1, wherein the slider layer is selected from the group consisting of rice hulls, buckwheat hulls, feathers, and a synthetic resin fiber in a spiral form.

5. The therapeutic seat cushion of claim 1, wherein the grooves in positions in front of, behind, to the right and to the left of each projection is deeper than the grooves disposed at a diagonal to said projections.

6. The therapeutic seat cushion of claim 1, wherein the sponge mat layer has a specific weight of about 0.01 to 0.05.

7. The therapeutic seat cushion of claim 1, wherein each projection is provided with a smaller projection which is disposed at one side of said projection.

8. The therapeutic seat cushion of claim 7, wherein adjacent rows of said projections are staggered with respect to each other.

9. The therapeutic seat cushion of claim 1, wherein a reinforcing, shock absorbing layer formed of a plate-type sponge mat which is harder than the sponge mat layer is disposed on the undersides of the slider layer.

10. The therapeutic seat cushion of claim 1, wherein a reinforcing, shock absorbing layer formed of a plate-type sponge mat which is harder than the sponge mat layer is disposed between the sponge mat layer and the slider layer.

11. The therapeutic seat cushion of claim 1, wherein the slider layer is much thinner relative to the sponge mat layer.

12. A wheeled chair provided with a therapeutic seat cushion which comprises:

a sponge mat layer comprising a polymeric foam including first and second surfaces;

said first surface contains a plurality of projections which extend from the first surface of the sponge mat layer;

said second surface being substantially flat; and a slider layer comprising a fibrous material positioned adjacent to the substantially flat second surface and being readily shiftable relative to said sponge mat layer;

whereby when a lateral force is applied to said seat cushion by a person positioned on said seat cushion, the relative positioning of the person and the sponge mat layer remains substantially constant relative to each other but shiftable relative to the slider layer thereby facilitating ready and comfortable movement of said person disposed on said seat cushion.

13. The wheeled chair of claim 12, wherein the sponge mat layer is polyurethane foam.

14. The wheeled chair of claim 12, wherein the slider layer is selected from the group consisting of rice hulls, buckwheat hulls, feathers and a synthetic resin fiber in a spiral form.

15. The wheeled chair of claim 12, wherein the grooves in positions in front of, behind, to the right and to the left of each projection is deeper than the grooves disposed at a diagonal to said projections.

16. The wheeled chair of claim 12, wherein each projection is provided with a smaller projection which is disposed at one side of said projection.

17. The wheeled chair of claim 12, wherein a reinforcing, shock absorbing layer formed of a plate-type sponge mat which is harder than the sponge mat layer is used in the seat cushion.

* * * * *